US006777335B2

(12) United States Patent
Hasegawa

(10) Patent No.: US 6,777,335 B2
(45) Date of Patent: Aug. 17, 2004

(54) POLISHING METHOD

(75) Inventor: Kou Hasegawa, Tokyo (JP)

(73) Assignee: JSR Corporation, Tokyo (JP)

( * ) Notice: Subject to any disclaimer, the term of this patent is extended or adjusted under 35 U.S.C. 154(b) by 0 days.

(21) Appl. No.: 09/995,613

(22) Filed: Nov. 29, 2001

(65) Prior Publication Data

US 2002/0098701 A1 Jul. 25, 2002

(30) Foreign Application Priority Data

Nov. 30, 2000 (JP) ..... 2000-365620
Dec. 26, 2000 (JP) ..... 2000-395729
Dec. 27, 2000 (JP) ..... 2000-398807

(51) Int. Cl.[7] ..... H01K 21/302
(52) U.S. Cl. ..... 438/691; 438/692; 438/614; 451/41
(58) Field of Search ..... 438/691, 692, 438/693, 694; 451/41; 216/88, 89

(56) References Cited

U.S. PATENT DOCUMENTS 3,979,239 A 9/1976 Walsh
4,600,469 A 7/1986 Fusco et al.
5,958,288 A * 9/1999 Mueller et al. ..... 252/186.1
6,194,317 B1 * 2/2001 Kaisaki et al. ..... 438/692

FOREIGN PATENT DOCUMENTS

| | | |
|---|---|---|
| EP | 1 046 466 | 10/2000 |
| JP | 10-329032 | 12/1998 |
| JP | 11-151659 | 6/1999 |
| JP | 11-188647 | 7/1999 |
| JP | 11-207632 | 8/1999 |
| WO | WO 94/04599 | 3/1994 |
| WO | WO 97/10613 | 3/1997 |
| WO | WO 99/24218 | 5/1999 |

* cited by examiner

*Primary Examiner*—Lan Vinh
(74) *Attorney, Agent, or Firm*—Oblon, Spivak, McClelland, Maier & Neustadt, P.C.

(57) ABSTRACT

It is an object of the present invention to provide a polishing method, with which a surface of high flatness can be obtained without fail at a high removal rate and in a stable manner. The polishing method is to polish a surface to be polished of an object to be polished by using a polishing pad while existing an aqueous chemical mechanical polishing solution containing an oxidizing agent such as hydrogen peroxide between polishing surface of the polishing pad equipped with a polishing part that contains abrasive, and the surface to be polished to be polished of the object to be polished. The aqueous chemical mechanical polishing solution may be contained a heterocyclic compound, a multivalent metal ion, an organic acid and the like. Also, the aqueous chemical mechanical solution may be contained no abrasive.

31 Claims, 1 Drawing Sheet

POLISHING METHOD

BACKGROUND OF THE INVENTION

1. Field of the Invention

The present invention relates to a polishing method, and to be more specific, relates to a polishing method using a polishing pad having a polishing part in which abrasive is dispersed, and an aqueous chemical mechanical polishing solution. The polishing method in the invention can be used favorably for the polishing of precision materials of various fields, for example, in the connection formation process of a DRAM, a high-speed logic LSI, or other semiconductor device requiring mixed installation of fine connections of approximately 0.1 $\mu$m to wide connections of approximately 100 $\mu$m. The polishing method in the invention is also especially favorable for polishing applications that require the attainment of a high degree of surface flatness.

2. Description of the Related Art

Chemical mechanical polishing, referred to as CMP, has been conventionally used for polishing the surfaces of semiconductor wafers and the like. In CMP, polishing is performed by sliding while pressing a surface to be polished of the wafer and the like against a disk-like polishing pad and at the same time, pouring a slurry, in which abrasive is dispersed, onto the polishing pad. However, it is difficult to supply the slurry (the abrasive in particular), which is poured from above, between the surface to be polished and polishing surface of the polishing pad, which are pressed against each other at high pressure, and it is said that the actual amount of functioning slurry is less than 1% of the total amount supplied. Moreover, this slurry is expensive and furthermore, vast costs are required for the treatment of used slurry.

Also, in cases where a slurry containing the abrasive is used to polish a surface wherein relatively soft parts and relatively hard parts coexist, since excessive polishing of the soft parts (the concave formed as a result is referred to as "erosion") cannot be prevented adequately, a limit is placed on the surface flatness that can be achieved in some cases. In particular, in the case where damascene connections are formed in the process of manufacturing a semiconductor wafer or other semiconductor device, the conductor layer is the soft part and the semiconductor layer, the barrier metal layer or the like is the hard part, and excessive polishing of the conductor layer will be a critical problem.

Polishing pads, in which the abrasive is contained, have been disclosed in Japanese Unexamined Patent Publication No. Hei-10-329032, Japanese Unexamined Patent Publication No. Hei-11-151659, Japanese Unexamined Patent Publication No. Hei-11-188647, Japanese Unexamined Patent Publication No. Hei-11-207632 and the like. However, adequate removal rates cannot be obtained with these polishing pads, especially in the polishing of a surface to be polished containing a metal such as tungsten, copper and aluminum.

SUMMARY OF THE INVENTION

The present invention can resolve the above problems, and an object thereof is to provide a polishing method, with which a surface of high flatness can be obtained without fail at a high removal rate and in a stable manner, and, in particular, provide a polishing method, with which the above effects can be obtained even for a surface to be polished that contains a metal such as copper, tungsten and the like.

This invention is described as follows.

1. A polishing method, characterized in that a surface to be polished of an object to be polished is polished by using a polishing pad while existing an aqueous chemical mechanical polishing solution containing an oxidizing agent between polishing surface of the above-mentioned polishing pad equipped with a polishing part that contains abrasive, and the above-mentioned surface to be polished of the above-mentioned object to be polished.

2. The polishing method according to 1 above wherein the above-mentioned abrasive is comprised of at least one selected from the group consisting of ceria, silica, alumina, titanium oxide, chromium oxide, manganese dioxide, dimanganese trioxide, iron oxide, zirconium oxide, silicon carbide, boron carbide, diamond and barium carbonate.

3. The polishing method according to 2 above wherein the above-mentioned polishing part is formed by solidifying an aqueous dispersion in which a matrix material and abrasive are respectively dispersed and contained.

4. The polishing method according to 3 above wherein abrasive is not contained in the above-mentioned aqueous chemical mechanical polishing solution.

5. The polishing method according to 4 above wherein at least one multivalent metal ion selected from the group consisting of multivalent ions of aluminum, titanium, chromium, manganese, iron, copper, zinc and cerium is further contained in the above-mentioned aqueous chemical mechanical polishing solution.

6. The polishing method according to 5 above wherein an organic acid is contained in the above-mentioned aqueous chemical mechanical polishing solution.

7. The polishing method according to 6 above wherein the above-mentioned surface to be polished of the above-mentioned object to be polished contains at least one element selected from the group consisting of metal elements belonging to the group 3 to 13.

8. The polishing method according to 7 above, which is to be used in the manufacture of a semiconductor device.

9. The polishing method according to 4 above wherein at least one heterocyclic compound selected from the group consisting of a condensed ring compound composed of a nitrogen-atom-containing penta-heterocyclic compound or a nitrogen-atom-containing hexa-heterocyclic compound and a benzene ring or a naphthalene ring is further contained in the above-mentioned aqueous chemical mechanical polishing solution.

10. The polishing method according to 9 above, which is to be used in the manufacture of a semiconductor device.

11. The polishing method according to 2 above wherein the above-mentioned polishing part is formed by solidifying an aqueous dispersion containing dispersed composite particles where abrasive is attached to a matrix material.

12. The polishing method according to 11 above wherein abrasive is not contained in the above-mentioned aqueous chemical mechanical polishing solution.

13. The polishing method according to 12 above wherein at least one multivalent metal ion selected from the group consisting of multivalent ions of aluminum, titanium, chromium, manganese, iron, copper, zinc and cerium is further contained in the above-mentioned aqueous chemical mechanical polishing solution.

14. The polishing method according to 13 above wherein an organic acid is contained in the above-mentioned aqueous chemical mechanical polishing solution.

15. The polishing method according to 14 above wherein the above-mentioned surface to be polished of the above-mentioned object to be polished contains at least one element selected from the group consisting of metal elements belonging to the group 3 to 13.

16. The polishing method according to 15 above, which is to be used in the manufacture of a semiconductor device.

17. The polishing method according to 12 above wherein at least one heterocyclic compound selected from the group consisting of a condensed ring compound composed of a nitrogen-atom-containing penta-heterocyclic compound or a nitrogen-atom-containing hexa-heterocyclic compound and a benzene ring or a naphthalene ring is further contained in the above-mentioned aqueous chemical mechanical polishing solution.

18. The polishing method according to 17 above wherein an organic acid is contained in the above-mentioned aqueous chemical mechanical polishing solution.

19. The polishing method according to 18 above wherein the above-mentioned surface to be polished of the above-mentioned object to be polished contains copper.

20. The polishing method according to 19 above, which is to be used in the manufacture of a semiconductor device.

According to the polishing method in the invention, a surface having high flatness can be obtained at a high removal rate and in a stable manner. In particular, since a slurry that contains an abrasive is not used, there is no need to take countermeasures against the aggregation of the abrasive during storage, transport or the like.

DETAILED DESCRIPTION OF THE INVENTION

This invention will now be described in more detail.

The above-mentioned "abrasive" is mainly a particle that exhibits a mechanical polishing action. The abrasive may be used a particle comprised of at least one selected from ceria, silica, alumina, titanium oxide, chromium oxide, manganese dioxide, dimanganese trioxide, iron oxide, zirconium oxide, silicon carbide, boron carbide, diamond and barium carbonate. Among these, ceria, silica and alumina are preferable. Since these are good in compatibility with water, they are high in dispersion property in water. And they can be contained in the polishing part of the polishing pad while being retained in a well-dispersed state after the aqueous dispersion containing the abrasive and the like is solidified. The abrasive in employing may be comprised of one kind above or be in combination of two or more. In the case where glass or other form of silicon oxide is polished, ceria is considered to exhibit a chemical polishing action in addition to a mechanical polishing action. The preferred abrasive is substantially spherical in shape and do not have any sharp corners.

Also, the abrasive is preferably high in purity. Preferable abrasive is for example, (1) abrasive produced by a fumed method in which silicone chloride, aluminum chloride, titanium chloride and the like is reacted with oxygen and hydrogen in the gas phase, (2) abrasive synthesized by a sol-gel method in which a metal alkoxide, such as tetraethoxysilane or titanium alkoxide and the like, is hydrolyzed and condensated, (3) abrasive produced by an inorganic colloid method in which impurities are removed by refining, and the like.

The mean particle diameter of the abrasive is preferably 0.005 to 50 $\mu$m, more preferably 0.005 to 10 $\mu$m, and even more preferably 0.01 to 1 $\mu$m. If the mean particle diameter is less than 0.005 $\mu$m, the polishing effect tends to be low. On the other hand, the mean particle diameter in the excess of 50 $\mu$m is not preferable in that there is a tendency for the probability of causing scratches to increase gradually since the abrasive is large. The mean particle diameter can be measured by using a transmission electron microscope.

The "polishing part" is comprised of a matrix phase and the abrasive contained therein. The abrasive may be contained in the polishing part in any form. For example, only the abrasive may be dispersed and contained in the matrix phase constituting the polishing part. And composite particles which the abrasive is attached to the peripheries of organic particles may be dispersed and contained in the matrix phase. However, the abrasive is preferably contained in the above-mentioned polishing part in the condition where its mean particle diameter is within the above-mentioned preferable particle diameter range.

The polishing part may comprise the entirety of the polishing pad or just a part of the polishing pad.

The "matrix material" is a material constituting the matrix phase that holds the abrasive in the polishing part of the polishing pad. Rubber, resin, thermoplastic elastomer and the like may be used as the matrix material. The matrix material may be used diene-based polymers, styrene-based polymers, (meth)acrylic-based polymers, olefin-based polymers, epoxy-based polymers, phenol-based polymers, polyimide-based polymers and the like. Among these, styrene-based polymers and (meth)acrylic-based polymers are preferable. Any of these polymers may be used alone or in combination of two or more. And these polymer may be a homopolymer or a copolymer.

The matrix material may be a crosslinked polymer or an uncrosslinked polymer, and is preferably crosslinked one.

The matrix material is preferably forming fine particles and dispersed in the aqueous dispersion containing thereof. The mean particle diameter of the fine particles is preferably 10 $\mu$m or less and more preferably 0.1 to 3 $\mu$m.

The amount of the matrix material constituting the polishing part is preferably 10 to 99% by volume, more preferably 15 to 70% by volume based on 100% by volume of the total of the matrix material and the abrasive.

The above-mentioned polishing part may contain an inorganic acid or organic acid which is not functioning as an oxidizing agent upon dissolving in the aqueous chemical mechanical polishing solution, a surfactant which is soluble in the aqueous chemical mechanical polishing solution, a hydroxide of an alkali metal, a chelating agent, a scratch inhibitor, an antistatic agent, a substance which dissolves in the aqueous chemical mechanical polishing solution to give rise to a multivalent metal ion, and the like.

The above-mentioned polishing part is preferably formed by the solidification of an aqueous dispersion, in which the matrix material and the abrasive are respectively dispersed and contained. Or, the above-mentioned polishing part is preferably formed by solidifying an aqueous dispersion, having dispersed and contained therein composite particles where the abrasive is attached to the matrix material. The aqueous dispersion may furthermore have the matrix material and/or the abrasive dispersed and contained therein.

That is, the above-mentioned polishing part is preferably obtained by solidification of an aqueous dispersion, which is (1) an aqueous dispersion, in which a matrix material and abrasive are contained and dispersed separately, (2) an aqueous dispersion, in which composite particles are contained and dispersed, (3) an aqueous dispersion, in which composite particles and abrasive are contained and dispersed, (4) an aqueous dispersion, in which composite particles and a matrix material are contained and dispersed, or (5) an aqueous dispersion, in which composite particles, a matrix material, and the abrasive are contained and dispersed.

The "composite particles" are particles, where the abrasive is attached to surface and/or interior of the matrix material. Attaching of the abrasive is not restricted to the surface of the composite particles. The method of attaching the abrasive to the matrix material is not restricted in particular, and the abrasive may be attached electrostatically to the matrix material by a zeta potential difference. In the case of this method, the zeta potentials of the matrix material and the abrasive are opposite in sign and the potential difference is preferably 5 mV or more and more preferably 10 mV or more. The zeta potential of the matrix material may be adjusted by the introduction of at least one type of group among a carboxyl group, a sulfonic acid group, an amino group, a sulfuric ester group, a phosphoric ester group, an ether-bond, an ester-bond and the like. Furthermore, the surface of the composite particles may be covered by a condensate comprised of a silane coupling agent, so that the attached abrasive will not drop off readily.

A dispersion medium of the above-mentioned "aqueous dispersion" may be just water or a mixed dispersion medium that contains a dispersion medium besides water. In the case of employing the mixed dispersion medium, the water content is preferably 10% by mass or more and more preferably 20% by mass or more based on 100% by mass of the mixed dispersion medium. Examples of the dispersion medium besides water that is to be contained in the mixed dispersion medium include non-protonic polar solvents, esters, ketones, phenols, alcohols, amines, and other dispersion media. The dispersion medium with a boiling point of 60 to 200° C. is preferably used so that excessive evaporation will not occur in the preparation of the aqueous dispersion and yet the removal of the dispersion medium can be performed readily.

The solid content of the aqueous dispersion is preferably 1 to 80% by mass and more preferably 10 to 60% by mass. A solid content in the excess of 80% by mass is not preferable in that the dispersion stability of the aqueous dispersion will tend to be low and precipitation can occur.

The aqueous dispersion is preferably one where the abrasive is dispersed in an emulsion in which the matrix material is dispersed. Among aqueous dispersions, the use of an emulsion, such as an emulsion obtained by emulsion polymerization, an emulsion obtained by emulsification using an emulsifying agent or the like, enables a polishing part, with which the dispersion of the abrasive is especially good, to be obtained.

The method of dispersing the matrix material in the aqueous dispersion is not restricted in particular. For example, the dispersion may be obtained by emulsion polymerization, suspension polymerization and the like, or by dissolving the previously obtained matrix material in a solvent or the like, and dispersing the resulting solution in water and the like.

Furthermore, the aqueous dispersion, in which the matrix material and the abrasive are dispersed, may be obtained by directly adding and dispersing the abrasive or by adding a previously prepared dispersion in which the abrasive is dispersed.

The aqueous dispersion may contain, if necessary, a surfactant, a substance which dissolves in the aqueous chemical mechanical polishing solution to give rise to a multivalent metal ion, a vulcanizing agent, a vulcanization accelerator, a crosslinking agent, a crosslinking accelerator, a filler, a foaming agent, hollow particles (expanding or non-expanding) which form voids, a softening agent, an antioxidant, an ultraviolet absorber, an antistatic agent, a plasticizer and the like.

Also, an oxidizing agent, a hydroxide of alkali metal, an acid, a pH adjuster, a chelating agent, a scratch inhibitor and the like which are conventionally contained in a slurry used in CMP may be employed.

The hydroxide of alkali metal may be used sodium hydroxide, potassium hydroxide, rubidium hydroxide, cesium hydroxide and the like. The hydroxide of alkali metal may be used alone or in combination of two or more.

The acid may be used an inorganic acid and an organic acid, which is indicated as examples in the description of the "aqueous chemical mechanical polishing solution" below. The inorganic acid may be used hydrochloric acid, nitric acid, sulfuric acid and the like. The acid may be used alone or in combination of two or more.

The chelating agent may be used ethylenediaminetetraacetic acid (EDTA), nitrilotriacetic acid, acetylacetone, bis-acetylacetoneethylenediimine, diethylenentriaminepentaacetic acid, glycoletherdiamine tetraacetic acid and the like. The chelating agent may be used alone or in combination of two or more.

The scratch inhibitor may be used biphenol, bipyridyl, 2-vinylpyridine, 4-vinylpyridine, salicylaldoxime, o-phenylenediamine, m-phenylenediamine, catechol, o-aminophenol, thiourea, N-alkyl-group-containing (meth) acrylamide, N-aminoalkyl-group-containing (meth) acrylamide, 7-hydroxy-5-methyl-1,3,4-triazaindolizine, 5-methyl-1H-benzotriazole, phthalazine, melamine, 3-amino-5,6-dimethyl-1,2,4-triazine and the like. The scratch inhibitor may be used alone or in combination of two or more.

The above-mentioned "solidification" normally requires a dispersion medium elimination process and a forming process. These processes may be carried out simultaneously or separately. Or, after eliminating the dispersion medium to some degree, forming may be performed and thereafter, complete elimination of the dispersion medium may be performed.

The elimination of the dispersion medium may for example be performed by leaving in an open system to eliminate the dispersion medium naturally by evaporation. The evaporation of the dispersion medium may furthermore be promoted by heating, depressurizing and the like. The dispersion medium may also be evaporated rapidly at the same time as in forming by a spray drying method and the like.

Meanwhile for forming, the residue, which has been made into lump, flake, powder, pellet or the like in form after elimination of the dispersion medium to some degree, may be subject to press molding, extrusion molding, injection molding and the like.

In the case of performing the elimination of the dispersion medium and forming simultaneously, the aqueous dispersion may be poured into a desired mold and solidification to the shape of the mold may be performed by eliminating the dispersion medium in the same manner as described above. Also, without using a mold, the aqueous dispersion may be developed across the surface of a film and the like which is to be the base material, and thereafter the dispersion medium may be eliminated in the same manner as described above.

Also, in the case where an aqueous dispersion, in which a crosslinkable matrix material is dispersed a non-crosslinked state, is solidified, crosslinking may be performed by heating and the like after solidification. Furthermore, in the case where the matrix material is a crosslinking polymer, a crosslinking copolymer or the like, the aqueous dispersion may be made to contain a binder and this may be solidified to bind the matrix material. The binder may be used a homopolymer and/or a copolymer which is the same as the above-mentioned matrix material.

In the polishing part obtained in the above manner, the abrasive is dispersed extremely well even though it is normally extremely difficult to disperse the abrasive in the matrix phase due to the low compatibility of the organic material (matrix material) and the inorganic material (abrasive). The volume ratio of the abrasive may be adjusted over a wide range, preferably from 1 to 90% by volume, more preferably 30 to 85% by volume.

The "aqueous chemical mechanical polishing solution" (hereinafter referred to simply as "aqueous solution") shall be described.

The above-mentioned aqueous solution is for existing between the polishing surface of the polishing pad and the surface to be polished of the object to be polished in the process of polishing the object to be polished by using the polishing pad. The above-mentioned "polishing surface" is a surface that at least includes the surface of the polishing part of the polishing pad and is the surface that is made to slide against the surface to be polished of the object to be polished in the polishing process.

An oxidizing agent and an aqueous medium that dissolves this oxidizing agent are normally contained in the above-mentioned aqueous solution. As the aqueous medium, just water or a medium containing water may be used. This aqueous medium may contain, for example, a non-protonic polar solvent, an ester, a ketone, a phenol, an alcohol, an amine and the like. These may be used alone or in combination of two or more. Water is contained in the above-mentioned aqueous solution at an amount of preferably 10% by mass or more and more preferably 20% by mass or more.

The above-mentioned "oxidizing agent" is for oxidizing the components that constitute the above-mentioned surface to be polished of the object to be polished. Especially in the case where the surface to be polished is a metal layer, the removal rate can be improved significantly by oxidization of the metal layer by the oxidizing agent and removing of the oxidized metal with the abrasive. The above-mentioned oxidizing agent is not restricted in particular, and normally, a water-soluble oxidizing agent is favorably used. Considering the electrochemical properties and the like of the surface to be polished, it is preferable to select the oxidizing agent using, for example, a Pourbaix line diagram and the like.

The above-mentioned oxidizing agent may be used inorganic peroxides such as hydrogen peroxide, persulfates such as ammonium persulfate and potassium persulfate, heteropolyacids such as silicomolybdic acid, phosphomolybdic acid, tungstosilicic acid and phosphotungstenic acid, permanganate compounds such as potassium permanganate, dichromate compounds such as potassium dichromate, halogenate compounds such as chlorates, chlorites, perchlorates and potassium iodate, nitrates such as nitric acid and iron nitrate, transition metal salts such as potassium ferricyanide, organic peroxides such as peracetic acid, perbenzoic acid and tert-butylhydroperoxide, and the like. Among these, hydrogen peroxide is especially preferable. By using hydrogen peroxide, treating the waste liquid after use is facilitated, and furthermore in the case of manufacture of a semiconductor device, the washing of the semiconductor device after polishing is facilitated. Any of these oxidizing agent may be used alone or in combination of two or more.

The preferable content of the above-mentioned oxidizing agent in the aqueous solution will differ according to the type of the oxidizing agent. In general, the content of the above-mentioned oxidizing agent is preferably 0.1 to 30 parts by mass and more preferably 1 to 10 parts by mass based on 100 parts by mass of the aqueous solution. If the content is less than 0.1 parts by mass, the removal rate may not be improved adequately. Meanwhile, if the content is exceeding 30 parts by mass, the surface to be polished may undergo excessive corrosion.

The "heterocyclic compound" may be used compounds with a penta-heterocyclic ring or a hexa-heterocyclic ring. Also, it is preferable for the heteroatom that comprises the heterocyclic ring to be at least one type of atom selected from among the nitrogen atom, sulfur atom and oxygen atom. Among these, the nitrogen atom is especially preferable.

The heterocyclic compound is preferably a condensed ring compound of a nitrogen-atom-containing penta-heterocyclic compound or a nitrogen-atom-containing hexa-heterocyclic compound and a benzene ring or a naphthalene ring. Furthermore, the heterocyclic compound is preferably a heterocyclic compound that is selected from among quinoline, isoquinoline, benzotriazole, benzoimidazole, indole, isoindole, quinazoline, cinnoline, quinoxaline, phthalazine and acridine, or is a heterocyclic compound having the structure of an above-mentioned compound. Among these, quinoline, benzotriazole, benzoimidazole, or a heterocyclic compound having the structure of quinoline, benzotriazole, or benzoimidazole is preferable, even more preferred is quinalidic acid, benzotriazole, or benzoimidazole, and quinalidic acid is especially preferable.

The content of the heterocyclic compound in the aqueous solution depends on the type of heterocyclic compound. In general, the content is preferably 0.01 to 3% by mass, more preferably 0.01 to 1% by mass and even more preferably 0.05 to 0.8% by mass with respect to the total amount of the above-mentioned aqueous solution. If the content is less than 0.01% by mass, it tends to be difficult to control erosion adequately. On the other hand, the desired effects can be obtained adequately if the content is 3% by mass.

The above-mentioned "multivalent metal ions" include the multivalent ions of transition metal element, Al, Zn, Cd, Sn, Sb, Hg, and Pb. Among these, the multivalent ions of Al, Ti, V, Cr, Mn, Fe, Co, Ni, Cu, Zn, Nb, Mo, Ru, Pd, Sn, Ag, Os and Ce are preferable and the multivalent ions of Al, Ti, V, Cr, Mn, Fe, Cu, Zn, Sn and Ce are especially preferably in that they effectively enable the removal rate higher. Any of these multivalent metal ions may be used alone or in combination of two or more.

The content of the multivalent metal ions in the aqueous solution is preferably 3 to 3,000 ppm, more preferably 10 to 2,000 ppm and even more preferably 30 to 1,000 ppm in the above-mentioned aqueous solution in general. If the content is less than 3 ppm, the effect of promoting the function of the oxidizing agent, which is an action of the multivalent metal ions, tends to be difficult to be obtained adequately. On the other hand, the content exceeding of 3,000 ppm is not preferable in that, in the case where a semiconductor device and the like is to be polished, soiling by the metal ion will tend to occur readily.

It is sufficient to be multivalent metal ions that result in the above-mentioned aqueous solution in the polishing process. And for example, the ions may be produced by dissolving a sulfate, acetate, or other salt of an above-mentioned metal element, a complex, or the like of the above-mentioned metal element in an aqueous medium. Also, even in the case where only univalent ions are produced immediately after dissolution in the aqueous medium, such ions may be converted into multivalent ions by means of the oxidizing agent.

An organic acid may be contained in the above-mentioned aqueous solution. However, this organic acid is different from the organic acids that function as the oxidizing agent in the above-mentioned aqueous solution. By using the aqueous solution containing the organic acid, the removal rate may be improved further.

The organic acid is preferably a compound with an acidic group, such as a carboxyl group, a hydroxyl group, and/or sulfone group. And examples include paratoluenesulfonic acid, dodecylbenzenesulfonic acid, isoprenesulfonic acid, glutaric acid, gluconic acid, adipic acid, lactic acid, citric acid, tartaric acid, malic acid, tannic acid, glycolic acid, malonic acid, formic acid, oxalic acid, succinic acid, fumaric acid, isophthalic acid, terephthalic acid, maleic acid, phthalic acid, gallic acid and the like. Among these, malonic acid and succinic acid are preferable. Any of these organic acids may be used alone or in combination of two or more.

The content of the above-mentioned organic acid is preferably 0.001 to 5% by mass, more preferably 0.05 to 3% by mass and particularly preferably 0.1 to 2% by mass with respect to the total amount of the aqueous solution. If the content is less than 0.001% by mass, the removal rate is not improved. On the other hand if the content is exceeding 5% by mass, the effect of improving the removal rate doesn't tend to be better.

The aqueous solution may, if necessary, also contain a surfactant, a hydroxide of an alkali metal, a chelating agent, a scratch inhibitor, an antistatic agent, an inorganic acid and the like which are used conventionally in a CMP slurry.

The above-mentioned surfactant is not restricted in particular, and a cationic surfactant, an anionic surfactant, a nonionic surfactant or the like may be used. Among these, an anionic surfactant is preferable. An anionic surfactant includes fatty acid soaps, carboxylic acid salts such as salts of alkyl ether carboxylic acids, sulfonic acid salts such as alkylbenzenesulfonates, alkylnaphthalenesulfonates, α-olefin ether sulfonates, sulfuric acid ester salts such as higher alcohol sulfate ester salts, alkyl ether sulfates, polyoxyethylene alkylphenyl ether sulfates, and phosphoric acid ester salts such as alkylphosphoric acid ester salts. Among these, the sulfonic acid salt such as potassium dodecylbenzenesulfonate and ammonium dodecylbenzenesulfonate is especially preferable. Any of these may be used alone or in combination of two or more.

The content of the surfactant existing between the polishing surface of the polishing pad and the surface to be polished of the object to be polished in polishing is preferably 0.001 to 0.1% by mass, more preferably 0.005 to 0.08% by mass with respect to the total of the above-mentioned aqueous solution. If the content is less than 0.001% by mass, adequate restraining of erosion tends to be difficult. On the other hand, there is no need for the content exceeding 0.1% by mass.

The sum content of the organic acid and the inorganic acid existing between the polishing surface of the polishing pad and the surface to be polished of the object to be polished in polishing is preferably 0.1 to 20% by mass and more preferably 0.3 to 10% by mass with respect to the total amount of the aqueous solution.

Though the above-mentioned aqueous solution may contain or not contain the abrasive, it is preferable for the aqueous solution not to contain the abrasive. The abrasive that have separated from the polishing part as a result of the polishing process may be contained in the above-mentioned aqueous solution during use.

In the case the surface to be polished of an object to be polished wherein relatively soft parts and hard parts coexist, is to be polished, the soft parts tend to be polished excessively because the abrasive is inclined to be held in the soft parts in the polishing process. On the other hand, using the above-mentioned aqueous solution without the abrasive makes the surface flat with especially high precision.

Furthermore, there will be no need to add additives or take other measures for preventing the aggregation of the abrasive. Thus when a surface to be polished, wherein relatively soft parts and hard parts are coexisting, is to be polished, it is preferable that the above-mentioned aqueous solution does not contain the abrasive, and furthermore, it is preferable that the abrasive dropping off from the polishing part is small in amount.

For the purpose of polishing one surface to be polished, just one type of the above-mentioned aqueous solution may be used or a plurality of types of aqueous solution may be used according to the polishing conditions. Particularly in the case where a semiconductor device is to be polished, it is preferable to change the components contained in the aqueous solution according to the object to be polished, such as the conductive layer, semiconductive layer, barrier metal layer and the like.

In the above, "exist between" means that the above-mentioned aqueous solution is to be made to exist as a result between the polishing surface of the polishing pad and the surface to be polished of the object to be polished, and the method therefor is not restricted in particular. For example, the aqueous solution may be poured from above as in prior arts to make it exist between the above-mentioned surfaces. The method of making the aqueous solution exist between polishing the surface of the polishing pad and the surface to be polished of the object to be polished directly from the surface of the polishing pad by providing a supply tube for supplying the aqueous solution in the polishing pad may also be used.

Examples of the above-mentioned "object to be polished" include semiconductor devices such as a DRAM, high-speed logic LSI, or other semiconductor device requiring mixed installation of fine connections of approximately 0.1 $\mu$m to wide connections of approximately 100 $\mu$m, magnetic disks, liquid crystal displays and the like. The shape of the object to be polished is not restricted in particular and may be a thin film or a plate. Furthermore, the material constituting the above-mentioned surface to be polished is not restricted in particular and may be a metal, ceramic, resin and the like. The surface to be polished may be a surface where a metal, ceramic, resin and the like are mixed. The type of metal is not restricted in particular and examples include aluminum, tungsten, copper, silicon, tantalum, niobium, titanium and the like, which belongs to group 3 to 13 of the periodic table, and alloys that contain these elements. Examples of ceramic materials include oxides, nitrides and the like of silicon, tantalum, niobium, and titanium (glass, amorphous silicon, polycrystalline silicon, monocrystalline silicon and the like are included among silicon oxides). Examples of resins include polyimide-based resins, benzocyclobutene and the like. Among these simple metals and alloys are preferable. The content of the simple metal or alloy is preferably 95% by mass or more with respect to all components constituting the surface to be polished.

According to the invention, the use of the aqueous solution containing the multivalent metal ions is favorable for polishing of tungsten. Also, the use of the aqueous solution containing the heterocyclic compound is favorable for polishing of copper.

The polishing method in the invention can be used favorably in the manufacture of semiconductor devices. Since the semiconductor device has a surface to be polished, wherein a conductive layer that is a relatively soft part, coexists with a semiconductive layer and/or a barrier metal layer that are relatively hard parts as has been mentioned above, an extremely high surface flatness can be obtained by the polishing method.

Materials constituting the conductive layer include a material to form a layer composing of at least one among aluminum, copper, tungsten and the like to be provided on the semiconductor substrate of an ultra LSI or the like as a major component whose content of any one of those metals is 95% by mass or more. Examples of such materials include pure aluminum, pure copper, pure tungsten, copper-silicon, copper-aluminum and the like.

Materials constituting the semiconductive layer include silicon, gallium, arsenic and the like.

Materials constituting the barrier metal layer include metals of high hardness such as tantalum, titanium and the like, and nitrides, oxides thereof. Also, the tantalum and the like does not have to be a pure product but may be an alloy, such as titanium-niobium and the like. Also, there is no need for tantalum nitride, titanium nitride and the like to be a pure product.

There is a need to polish an insulating layer in the manufacture of a semiconductor device. This insulating layer may be a relatively soft in some cases and may be a relatively hard in some cases. Examples of such an insulating layer include thermally oxidized layers such as $SiO_2$ layers and plasma TEOS, and insulating layers of low dielectric constant for the purpose of improving the performance of ultra LSI's. Examples of such an insulating layer of low dielectric constant include silsesquioxane (dielectric constant; approx. 2.6 to 3.0), fluorine-added $SiO_2$ (dielectric constant; approx. 3.3 to 3.5), polyimide-based resin (dielectric constant; approx. 2.4 to 3.6; product name; "PIQ," made by Hitachi Chemical Co., Ltd., product name; "FLARE," made by Allied Signal Corp., etc.), benzocyclobutene (dielectric constant; approx. 2.7, product name; "BCB," made by Dow Chemical Corp., etc.), hydrogen-containing SOG (dielectric constant; approx. 2.5 to 3.5), organic SOG (dielectric constant; approx. 2.9, product name; "HSGR7," made by Hitachi Chemical Co., Ltd., etc.) and the like.

In the case of polishing a tungsten layer using an aqueous solution containing an oxidizing agent and an organic acid under the condition described below in Example, the removal rate of the tungsten layer may be set preferably to 700 Å/minute or more, more preferably to 800 Å/minute or more, and even more preferably to 1,000 Å/minute or more. If the above-mentioned aqueous solution contains multivalent metal ions, the removal rate of the tungsten layer may be set preferably to 800 Å/minute or more, more preferably to 900 Å/minute or more, and even more preferably to 1,100 Å/minute or more. In all cases, a polished surface of high surface flatness can be obtained.

In the case of polishing a copper layer using an aqueous solution containing an oxidizing agent, an organic acid and the heterocyclic compound under the condition described below in Example, the removal rate of the copper layer may be set preferably to 1,500 Å/minute or more, more preferably to 2,500 Å/minute or more, and even more preferably to 2,500 Å/minute or more, and a polished surface of high surface flatness can be obtained.

The polishing method in the invention may be carried out using a commercially available chemical mechanical polishing device, for example, the models "EPO-112" and "EPO-222," made by Ebara Manufacturing Co., Ltd., the models "LGP-510" and "LGP-552," made by Lapmaster SFT Corp., the device of the product name, "Mirra," made by Applied Materials Corp., etc.

PREFFERED EMBODMENTS OF THE INVENTION

Figure 1:
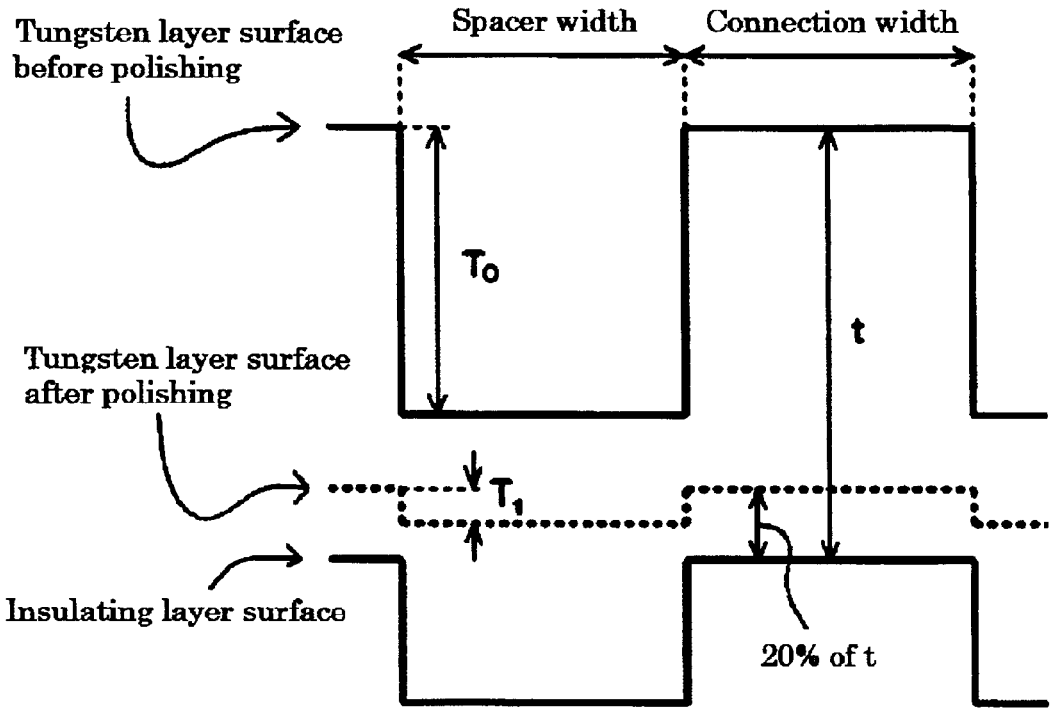
FIG. 1 is an explanatory diagram for explaining the method of determining the degree of surface flatness of a sample surface polished by an embodiment.

This present invention is further described in detail in the following examples.

TEST EXAMPLE 1

With this test example, the manufacture of a polishing pad is investigated.

[1] Preparation of Aqueous Dispersions (A) to (C)

(1—1) Aqueous Dispersion (A), Having a Matrix Material and Abrasive Dispersed Therein The respective components shown in Table 1 were loaded at the respective proportions into a temperature-adjustable autoclave, equipped with a stirrer, and were made to react for 16 hours at 75° C. As a result, the polymerization conversion was 95.8% and an emulsion was obtained in which a styrene copolymer, whose glass transition temperature is 50° C. and whose mean particle diameter is 166 nm, was dispersed.

The mean particle diameter was measured using a laser particle size analysis system made by Otsuka Electronics Co., Ltd. (in the description that follows, the mean particle diameter was measured by the same method).

TABLE 1

Aqueous dispersion (A)

| Component | Amount (Parts by mass) |
|---|---|
| Butadiene | 15.0 |
| Styrene | 70.0 |
| Methyl methacrylate | 12.0 |
| Itaconic acid | 2.0 |
| Acrylic acid | 1.0 |
| α-Methylstyrene dimer | 0.1 |
| t-Dodecylmercaptan | 0.4 |
| Ion-exchanged water | 240 |

The emulsion that was obtained was adjusted to pH8.5 by means of a 25% aqueous solution of potassium hydroxide. Thereafter, ion-exchanged water was added, and after stirring under room temperature using Three-One Motor, a ceria ($CeO_2$) powder, having a mean particle diameter of 0.3 $\mu$m prior to processing, was loaded and further stirring at 1,500 rotations/minute was carried out for 3 minute to obtain an aqueous dispersion (A).

(1-2) Aqueous Dispersion (B), Having Composite Particles, Where Abrasive is Attached to a Matrix Material, Dispersed The respective components shown in Table 2 were loaded at the respective proportions into a flask of 2-liter volume and were made to undergo polymerization under a nitrogen atmosphere by stirring at 70° C. for 6 hours. An emulsion, containing methyl methacrylate copolymer particles, having an amino group, which is a cationic functional group, and a functional group with a polyethylene glycol chain, was thereby obtained. The polymerization yield was 95%.

The product of the trade name, "NK Ester M-90 G" #400, made by Shin-Nakamura Chemical Co., Ltd., was used as the methoxypolyethylene glycol methacrylate in Table 2, and the product of the trade name, "V50" made by Wako Pure Chemicals Industries, Ltd., was used as the azo polymerization initiator.

TABLE 2

Aqueous dispersion (B)

| Component | Amount (Parts by mass) |
|---|---|
| Methyl methacrylate | 90.0 |
| Methoxypolyethylene glycol methacrylate | 5.0 |
| 4-Vinylpyridine | 5.0 |
| Azo polymerization initiator | 2.0 |
| Ion-exchanged water | 400 |

The obtained emulsion containing 10% by mass of methyl methacrylate copolymer particles, was then adjusted to pH10 by means of potassium hydroxide. The zeta potential of the methyl methacrylate copolymer particles in this emulsion was +12 mV. Meanwhile, the dispersion preparing to contain 10% by mass of fumed silica particle (product No. #90, made by Nippon Aerosil Co., Ltd.) was adjusted likewise to pH10. The zeta potential of the silica particles in this dispersion was −35 mV.

Thereafter, the above emulsion and dispersion were loaded into a flask of 2-liter volume so that their mass ratio will be 1:1 and then mixed by stirring. 3 parts by mass of tetraethoxysilane were then added and then stirring for 1 hour at 25° C., followed by stirring for 3 hours at 40° C., was performed. The mixture was then cooled to obtain an aqueous dispersion (B) in which composite particles were dispersed. Silica was attached to 95% of the surface of these composite particles.

(1-3) Aqueous Dispersion (C), Having Composite Particles, Where Abrasive is Attached to a Matrix Material, Dispersed The respective components shown in Table 3 were loaded at the respective proportions into a flask of 2-liter volume and were made to undergo polymerization under a nitrogen atmosphere by stirring at 70° C. for 6 hours. An emulsion, containing methyl methacrylate copolymer particles, having a carboxyl group and a hydroxyl group, was thereby obtained. The polymerization yield was 95%, and the carboxyl group content as measured by the conductometric titration method was 30% for the particle interior, 60% for the surface, and 10% for the aqueous phase part.

TABLE 3

| Aqueous dispersion (C) | |
|---|---|
| Component | Amount (Parts by mass) |
| Methyl methacrylate | 94.0 |
| Methacrylic acid | 4.0 |
| Hydroxymethyl methacrylate | 2.0 |
| Ammonium lauryl sulfate | 0.1 |
| Ammonium persulfate | 0.5 |
| Ion-exchanged water | 400 |

The obtained emulsion, which contained 10% by mass of methyl methacrylate copolymer particles, was then adjusted to pH4 by means of nitric acid. The zeta potential of the methyl methacrylate copolymer particles in this emulsion was −25 mV. Meanwhile, the dispersion, which was prepared to contain 10% by mass of ceria powder with a mean particle diameter of 0.3 μm prior to processing, was adjusted likewise to pH4. The zeta potential of the ceria in this dispersion was +20 mV.

Thereafter, the above emulsion and dispersion were loaded into a flask of 2-liter volume so that their mass ratio will be 1:1 and then mixed by stirring. 3 parts by mass of tetraethoxysilane was then added and then stirring for 1 hour at 25° C., followed by stirring for 3 hours at 40° C., was performed. The mixture was then cooled to obtain an aqueous dispersion (C) in which composite particles were dispersed. Ceria was attached to 90% of the surface of the composite particles.

[2] Solidification

Each of the above-described aqueous dispersions (A) to (C) was spread thinly on a polyethylene film and made flake-like in form by leaving and drying for 48 hours under room temperature. The flakes thus obtained were then powdered using a mixer. Then using the respective powders, disk-shaped polishing pads [A] to [C] of 30 cm diameter and 3 mm thickness were obtained using a mold press.

TEST EXAMPLE 2

With this test example, the preparation of aqueous chemical mechanical polishing solutions and the performance of polishing using these solutions were investigated.

[1] Polishing of Tungsten Wafers

(i) EXAMPLES 1 TO 3 AND COMPARATIVE EXAMPLES 1 TO 5

Aqueous chemical mechanical polishing solution (I) was prepared by incorporating hydrogen peroxide to an amount of 2% by mass and malonic acid to an amount of 1% by mass in ion-exchanged water.

Each of the abrasive-containing polishing pads [A] to [C], which were obtained in the manner described above, and polishing pad [D] (trade name, "IC1000/SUBA400," made by Rodel Nitta Co.), which does not contain the abrasive, was adhered onto the surface table of a polishing device (model "LM-15," made by Lapmaster STF Corp.). Then using each polishing pad, a 4 cm-square tungsten wafer (trade name, "SKW-5," made by SKW Co., Ltd.) was polished while supplying aqueous solution (I) at a rate of 150 ml per minute. In this process, the table rotation speed was set to 50 rpm, the polishing pressure was set to 350 g/cm$^2$, and the polishing time was set to 2 minute intervals.

The surface resistance value of the tungsten layer was measured by the DC 4-terminal method using a resistivity measuring device (model "Σ-10" made by NPS Corp.), and using the equation (1) shown below, and the thickness of the tungsten layer was calculated from the ratio with respect to the resistivity of tungsten. Then from the thickness values of the tungsten layer before and after polishing, the removal rate was calculated using the equation (2) shown below.

$$\text{Thickness of tungsten layer}=\{\text{Resistivity of tungsten } (\Omega/\text{cm})\}/\{\text{Resistance value } (\Omega/\text{cm}^2)\} \quad (1)$$

$$\text{Removal rate } (\text{Å/minute})=(\text{Thickness of tungsten layer before polishing}-\text{Thickness of tungsten layer after polishing})/\text{Polishing time} \quad (2)$$

Furthermore, polishing was performed in likewise manner while supplying just ion exchanged water or a slurry (trade name, "W2000," made by Cabot Corp.), containing the abrasive, in place of aqueous solution (I) and the removal rate for the respective cases were determined (Comparative example 5).

Next, with an above-mentioned tungsten wafer, where the pitch is 200 μm (line width: 100 μm, spacer width: 100 μm), the distance $T_0$, from the tungsten layer surface to the bottom surface of the spacer, is 10,000 Å, and the distance t, from the tungsten layer surface to the surface of the insulating layer is 15,000 Å, polishing of the wafer surface was performed until the distance t became 20% the original distance. After polishing, the distance $T_1$, from the tungsten layer surface to the bottom surface of the indented part after polishing that is formed at the location where the spacer was formed, was measured, and the value ($T_1/T_0$), obtained by dividing $T_1$ by $T_0$, was indicated as the degree of surface flatness in Table 4. A smaller value of this degree of surface flatness indicates that polishing of excellent surface flatness can be performed (see FIG. 1). $T_0$ and $T_1$ were measured using a fine profile measuring device (model "P-10," made by KLA-Tencor Corp.). The results are shown in Table 4.

TABLE 4

| | Example 1 | Example 2 | Example 3 | Comparative example 4 |
|---|---|---|---|---|
| Polishing pad | polishing pad [A] (containing abrasive) | polishing pad [B] (containing abrasive) | polishing pad [C] (containing abrasive) | polishing pad [D] (containing no abrasive) |
| liquid used | aqueous solution (I) (containing no abrasive) | aqueous solution (I) (containing no abrasive) | aqueous solution (I) (containing no abrasive) | aqueous solution (I) (containing no abrasive) |
| Removal rate (Å/min) | 1080 | 1250 | 1130 | less than 50 |
| Degree of flatness ($T_1/T_0$) | less than 0.01 | less than 0.01 | less than 0.01 | — |

TABLE 4-continued

| | Comparative example 1 | Comparative example 2 | Comparative example 3 | Comparative example 5 |
|---|---|---|---|---|
| Polishing pad | polishing pad [A] (containing abrasive) | polishing pad [B] (containing abrasive) | polishing pad [C] (containing abrasive) | polishing pad [D] (containing no abrasive) |
| liquid used | water (containing no abrasive) | water (containing no abrasive) | water (containing no abrasive) | slurry (containing abrasive) |
| Removal rate (Å/min) | 480 | 570 | 460 | 1120 |
| Degree of flatness ($T_1/T_0$) | less than 0.01 | less than 0.01 | less than 0.01 | 0.23 |

The results in Table 4 show that the removal rates in the cases where aqueous solution (I) was used were 2.19 to 2.46 times those in the cases where just water was used for polishing, that is, the removal rate can be increased by 2 times or more in all cases.

Whereas polishing was barely achieved in Comparative Example 4, wherein a polishing pad [D], which does not contain the abrasive, and aqueous solution (I) were used, a large removal rate was achieved as exhibited by Comparative Example 5 when a slurry containing the abrasive was used in place of aqueous solution (I). However, the degree of surface flatness took on a large value of 0.23 in the case of Comparative Example 5. In contrast, with all of Examples 1 to 3, extremely low values of the degree of surface flatness of less than 0.01 were achieved even while achieving high removal rates.

(ii) EXAMPLES 4 TO 6 AND COMPARATIVE EXAMPLES 6 TO 10

Aqueous chemical mechanical polishing solution (II) was prepared by incorporating hydrogen peroxide to an amount of 3% by mass, succinic acid to an amount of 2% by mass, ammonium dodecylbenzenesulfonate to an amount of 0.01% by mass, and iron ions (incorporated as iron sulfate) to an amount of 200 ppm in ion-exchanged water.

Except for supplying aqueous solution (II) at a rate of 200 ml per minute and setting the table rotation speed to 55 rpm, tungsten wafers were polished and the removal rates were determined in the same manner as in [1] above. The results are shown in Table 5. Degrees of surface flatness were determined in the same manner and the results are also shown in Table 5.

The results in Table 5 show that the removal rates in the cases where aqueous solution (II) was used were 2.51 to 2.77 times those in the cases where just water was used for polishing, that is, the removal rate can be increased by 2.5 times or more in all cases.

Whereas polishing was barely achieved in Comparative Example 9, wherein a polishing pad [D], which does not contain the abrasive, and aqueous solution (II) were used, a large removal rate was achieved as exhibited by Comparative Example 10 when a slurry containing the abrasive was used in place of aqueous solution (II). However, the degree of surface flatness took on a large value of 0.28 in the case of Comparative Example 10. In contrast, with all of Examples 4 to 6, extremely low values of the degree of surface flatness of less than 0.01 were achieved even while achieving high removal rates.

[2] Polishing of Wafers With Copper Layer

(iii) EXAMPLES 7 TO 9 AND COMPARATIVE EXAMPLES 11 TO 15

Aqueous chemical mechanical polishing solution (III) was prepared by incorporated hydrogen peroxide of an amount of 4% by mass, quinalidic acid of an amount of 0.3% by mass, malonic acid of an amount of 1% by mass, and potassium dodecylbenzenesulfonate of an amount of 0.02% by mass in ion-exchanged water and adjusting the pH9.0 by ammonia.

Each of the above-mentioned polishing pads [A] to [D] were adhered onto the surface table of the above-mentioned polishing device, and while supplying aqueous solution (III) at a rate of 150 ml per minute, a 4 cm-square wafer with copper layer was polished. In this process, the table rotation

TABLE 5

| | Example 4 | Example 5 | Example 6 | Comparative example 9 |
|---|---|---|---|---|
| Polishing pad | polishing pad [A] (containing abrasive) | polishing pad [B] (containing abrasive) | polishing pad [C] (containing abrasive) | polishing pad [D] (containing no abrasive) |
| liquid used | aqueous solution (II) (containing no abrasive) | aqueous solution (II) (containing no abrasive) | aqueous solution (II) (containing no abrasive) | aqueous solution (II) (containing no abrasive) |
| Removal rate (Å/min) | 1280 | 1450 | 1330 | less than 50 |
| Degree of flatness ($T_1/T_0$) | less than 0.01 | less than 0.01 | less than 0.01 | — |
| | Comparative example 6 | Comparative example 7 | Comparative example 8 | Comparative example 10 |
| Polishing pad | polishing pad [A] (containing abrasive) | polishing pad [B] (containing abrasive) | polishing pad [C] (containing abrasive) | polishing pad [D] (containing no abrasive) |
| liquid used | water (containing no abrasive) | water (containing no abrasive) | water (containing no abrasive) | slurry (containing abrasive) |
| Removal rate (Å/min) | 510 | 550 | 480 | 1220 |
| Degree of flatness ($T_1/T_0$) | less than 0.01 | less than 0.01 | less than 0.01 | 0.28 |

speed was set to 50 rpm, the polishing pressure was set to 350 g/cm$^2$, and the polishing time was set to 2 minute intervals. The removal rate of copper layer was measured in the same manner as described above. Furthermore, polishing was performed in likewise manner while supplying just ion-exchanged water or a slurry, obtained by dispersing 1% by mass of fumed silica as the abrasive in aqueous solution (III), in place of aqueous solution (III) and the removal rates for the respective cases were determined in the same manner as in the tungsten cases (see Table 6).

Next, with the above-mentioned copper wafer, where the pitch is 200 $\mu$m (line width: 100 $\mu$m, spacer width: 100 $\mu$m), the distance $T_0$, from the copper layer surface to the bottom surface of the spacer, is 7,000 Å, and the distance t, from the copper layer surface to the surface of the insulating layer is 15,000 Å, polishing of the wafer surface was performed until the distance t became 20% the original distance. After polishing, the distance $T_1$, from the copper layer surface to the bottom surface of the indented part after polishing that is formed at the location where the spacer was formed, was measured, and the degree of surface flatness, obtained in the same manner as described above using the value ($T_1/T_0$), obtained by dividing $T_1$ by $T_0$, was indicated as the degree of surface flatness in Table 6.

TABLE 6

| | Example 7 | Example 8 | Example 9 | Comparative example 14 |
|---|---|---|---|---|
| Polishing pad | polishing pad [A] (containing abrasive) | polishing pad [B] (containing abrasive) | polishing pad [C] (containing abrasive) | polishing pad [D] (containing no abrasive) |
| liquid used | aqueous solution (III) (containing no abrasive) | aqueous solution (III) (containing no abrasive) | aqueous solution (III) (containing no abrasive) | aqueous solution (III) (containing no abrasive) |
| Removal rate (Å/min) | 3200 | 3300 | 3200 | less than 50 |
| Degree of flatness ($T_1/T_0$) | less than 0.01 | less than 0.01 | less than 0.01 | — |
| | Comparative example 11 | Comparative example 12 | Comparative example 13 | Comparative example 15 |
| Polishing pad | polishing pad [A] (containing abrasive) | polishing pad [B] (containing abrasive) | polishing pad [C] (containing abrasive) | polishing pad [D] (containing no abrasive) |
| liquid used | water (containing no abrasive) | water (containing no abrasive) | water (containing no abrasive) | slurry (containing abrasive) |
| Removal rate (Å/min) | 900 | 1000 | 1100 | 3000 |
| Degree of flatness ($T_1/T_0$) | less than 0.01 | less than 0.01 | less than 0.01 | 0.3 |

The results in Table 6 show that the removal rates in the cases where aqueous solution (III) was used were 2.91 to 3.60 times those in the cases where just water was used for polishing, that is, the removal rate can be increased by 2.5 times or more in all cases.

Whereas polishing was barely achieved in Comparative Example 14, wherein a polishing pad [D], which does not contain the abrasive, and aqueous solution (III) were used, a large removal rate was achieved as exhibited by Comparative Example 15 when a slurry containing the abrasive was used in place of aqueous solution (III). However, the degree of surface flatness took on a large value of 0.3 in the case of Comparative Example 15. In contrast, with all of Examples 7 to 9, extremely low values of the degree of surface flatness of less than 0.01 were achieved even while achieving high removal rates.

What is claimed is:

1. A polishing method comprising: polishing a surface of an object by using a polishing pad having a polishing part that is formed by solidifying an aqueous dispersion in which a matrix material and an abrasive are respectively dispersed and contained, while there is present an aqueous chemical mechanical polishing solution containing an oxidizing agent and no abrasive between a polishing surface of said polishing pad having said polishing part and said surface of said object.

2. The polishing method according to claim 1, wherein said matrix material is comprised of at least one selected from the group consisting of diene-based polymers and styrene-based polymers.

3. The polishing method according to claim 1, wherein the mean particle diameter of said matrix material is 0.1 to 3 $\mu$m and the mean particle diameter of said abrasive is 0.01 to 1 $\mu$m.

4. The polishing method according to claim 3, wherein said abrasive is comprised of at least one selected from the group consisting of ceria, silica, alumina, titanium oxide, chromium oxide, manganese dioxide, dimanganese trioxide, iron oxide, zirconium oxide, silicon carbide, boron carbide, diamond and barium carbonate.

5. The polishing method according to claim 4, wherein at least one multivalent metal ion selected from the group consisting of multivalent ions of aluminum, titanium, chromium, manganese, iron, copper, zinc and cerium is further contained in said aqueous chemical mechanical polishing solution.

6. The polishing method according to claim 5 wherein an organic acid is contained in said aqueous chemical mechanical polishing solution.

7. The polishing method according to claim 6 wherein said surface to be polished of said object to be polished contains at least one element selected from the group consisting of metal elements belonging to the group 3 to 13.

8. The polishing method according to claim 7, used in the manufacture of a semiconductor device.

9. The polishing method according to claim 4, wherein at least one heterocyclic compound selected from the group consisting of a condensed ring compound composed of a nitrogen-atom-containing penta-heterocyclic compound or a nitrogen-atom-containing hexa-heterocyclic compound and a benzene ring or a naphthalene ring is further contained in said aqueous chemical mechanical polishing solution.

10. The polishing method according to claim 9, used in the manufacture of a semiconductor device.

11. The polishing method according to claim 1, wherein said aqueous dispersion is prepared by adding an abrasive or a dispersion containing an abrasive to an emulsion obtained from emulsion polymerization, an emulsion obtained from emulsification using an emulsifying agent, or a suspension obtained from suspension polymerization.

12. The polishing method according to claim 11, wherein said aqueous dispersion is prepared by adding an abrasive or a dispersion containing an abrasive to an emulsion obtained from emulsion polymerization.

13. The polishing method according to claim 11, wherein said abrasive is comprised of at least one selected from the group consisting of ceria, silica, alumina, titanium oxide, chromium oxide, manganese dioxide, dimanganese trioxide, iron oxide, zirconium oxide, silicon carbide, boron carbide, diamond and barium carbonate.

14. The polishing method according to claim 13, wherein at least one multivalent metal ion selected from the group consisting of multivalent ions of aluminum, titanium, chromium, manganese, iron, copper, zinc and cerium is further contained in said aqueous chemical mechanical polishing solution.

15. The polishing method according to claim 14, wherein an organic acid is contained in said aqueous chemical mechanical polishing solution.

16. The polishing method according to claim 15, wherein said surface to be polished of said object to be polished contains at least one element selected from the group consisting of metal elements belonging to the group 3 to 13.

17. The polishing method according to claim 16, used in the manufacture of a semiconductor device.

18. The polishing method according to claim 13, wherein at least one heterocyclic compound selected from the group consisting of a condensed ring compound composed of a nitrogen-atom-containing penta-heterocyclic compound or a nitrogen-ato-containing hexa-heterocyclic compound and a benzene ring or a naphthalene ring is further contained in said aqueous chemical mechanical polishing solution.

19. The polishing method according to claim 18, used in the manufacture of a semiconductor device.

20. A polishing method comprising: polishing a surface of an object by using a polishing pad having a polishing part wherein said polishing part that is formed by solidifying an aqueous dispersion containing dispersed composite particles where abrasive is attached to a matrix material, while there is present an aqueous chemical mechanical polishing solution containing an oxidizing agent and no abrasive between a polishing surface of said polishing pad having said polishing part and said surface of said object.

21. The polishing method according to claim 20, wherein said matrix material and said abrasive constituting said composite particle are electrostatically attached each other.

22. The polishing method according to claim 21, wherein zeta potentials of said matrix material and said abrasive are opposite in sign and potential difference is 5 mV or more.

23. The polishing method according to claim 20, wherein said abrasive is comprised of at least one selected from the group consisting of ceria, silica, alumina, titanium oxide, chromium oxide, manganese dioxide, dimanganese trioxide, iron oxide, zirconium oxide, silicon carbide, boron carbide, diamond and barium carbonate.

24. The polishing method according to claim 23, wherein at least one multivalent metal ion selected from the group consisting of multivalent ions of aluminum, titanium, chromium, manganese, iron, copper, zinc and cerium is further contained in said aqueous chemical mechanical polishing solution.

25. The polishing method according to claim 23, wherein an organic acid is contained in said aqueous chemical mechanical polishing solution.

26. The polishing method according to claim 25 wherein said surface to be polished of said object to be polished contains at least one element selected from the group consisting of metal elements belonging to the group 3 to 13.

27. The polishing method according to claim 26, used in the manufacture of a semiconductor device.

28. The polishing method according to claim 23, wherein at least one heterocyclic compound selected from the group consisting of a condensed ring compound composed of a nitrogen-atom-containing penta-heterocyclic compound or a nitrogen-atom-containing hexaheterocyclic compound and a benzene ring or a naphthalene ring is further contained in said aqueous chemical mechanical polishing solution.

29. The polishing method according to claim 28 wherein an organic acid is contained in said aqueous chemical mechanical polishing solution.

30. The polishing method according to claim 29 wherein said surface to be polished of said object to be polished contains copper.

31. The polishing method according to claim 30, used in the manufacture of a semiconductor device.

* * * * *